US011454165B2

(12) United States Patent
Collett et al.

(10) Patent No.: US 11,454,165 B2
(45) Date of Patent: Sep. 27, 2022

(54) OPTIMAL EFFICIENCY INTERNAL COMBUSTION ENGINE

(71) Applicants: Glen Alton Collett, Sandy, UT (US); Ernest Emanuel Rogers, Pleasant Grove, UT (US)

(72) Inventors: Glen Alton Collett, Sandy, UT (US); Ernest Emanuel Rogers, Pleasant Grove, UT (US)

(73) Assignee: CREED ENGINES, LLC, Sandy, UT (US)

( * ) Notice: Subject to any disclaimer, the term of this patent is extended or adjusted under 35 U.S.C. 154(b) by 0 days.

(21) Appl. No.: 17/160,356

(22) Filed: Jan. 27, 2021

(65) Prior Publication Data

US 2021/0239039 A1 Aug. 5, 2021

Related U.S. Application Data

(60) Provisional application No. 62/969,090, filed on Feb. 2, 2020.

(51) Int. Cl.

| | |
|---|---|
| ***F02B 75/28*** | (2006.01) |
| ***F02B 25/08*** | (2006.01) |
| ***F02B 75/02*** | (2006.01) |
| ***F02B 3/06*** | (2006.01) |

(52) U.S. Cl.

CPC ..... *F02B 75/28* (2013.01); *F02B 25/08* (2013.01); *F02B 3/06* (2013.01); *F02B 2075/025* (2013.01)

(58) Field of Classification Search

CPC ..... F02B 3/06; F02B 25/08; F02B 75/28

See application file for complete search history.

(56) References Cited

U.S. PATENT DOCUMENTS

| | | | | |
|---|---|---|---|---|
| 5,507,253 | A * | 4/1996 | Lowi, Jr. | F01B 3/045 123/56.9 |
| 2010/0154749 | A1* | 6/2010 | Barberato | F02B 75/32 123/48 C |
| 2012/0085302 | A1* | 4/2012 | Cleeves | F02D 15/00 123/55.2 |
| 2012/0125288 | A1* | 5/2012 | Simpson | F02B 63/041 123/27 R |

* cited by examiner

*Primary Examiner* — Kevin A Lathers

(57) ABSTRACT

An engine and method for achieving superior operational benefits by application of the General Cycle for heat engines. A two-stroke internal combustion engine having an Atkinson ratio A and a compression ratio $R_C$, the compression ratio having a value in the range from 19 to 30, and an Atkinson ratio selected such that the product of Atkinson ratio and compression ratio is near to and generally greater than 36. The best values of this product, $AR_C$, vary slightly with the choice of compression ratio according to the following relationship:

$$AR_C \geq 36.33+8788e^{-0.375R_C}.$$

The engine includes a conventional exhaust valve and may include a high ratio of stroke length to bore, or may be of an opposed piston construction.

13 Claims, 4 Drawing Sheets

OPTIMAL EFFICIENCY INTERNAL COMBUSTION ENGINE

BACKGROUND

We on earth (7.8 billion people in 2021) are destroying our planet by wasteful use of resources, and in particular by wasting energy. Of all the vast production of energy on the planet, now at over $600\times10^{15}$ BTUs (630 EJ) per year, about 80% is from burning fossil fuels at very low efficiency. Renewable energy sources are beginning to replace fossil fuel use, but the best solution in the near term, to meet our energy needs with far less dependence on fossil fuels, is to improve energy efficiency of fuel use. Our invention—a high efficiency engine—is directed to that purpose. It is particularly useful for combined heat and power applications where a combined efficiency of 90% or more may be achieved. Our engine, or engines, are ideally suited for use with renewable fuels.

PRIOR ART

The scientific principles of operation of internal combustion engines have been known for approximately 130 years, after Rudolph Diesel first applied the concept of the thermodynamic cycle in 1892, just 16 years after the foundation concepts were introduced by Willard Gibbs. Modern theory of the thermodynamic cycles of internal combustion engines began with Diesel's work. In Diesel's US patent 608,845, he presents what has become known as the "Diesel cycle." Today, the five well-known internal-combustion engine cycles are represented by standard reversible forms composed of isentropic, isochoric, and isobaric process steps. Those five cycles are: Diesel cycle, Otto cycle, dual cycle, Brayton cycle, and the Atkinson (or Miller) cycle. It was not generally known until recently that a sixth comprehensive standard thermodynamic cycle includes and extends the five prior cycles—we refer to this improved cycle as The General Cycle.

BRIEF SUMMARY OF THE INVENTION

A thorough description of the General Cycle is provided in the reference: Ernest Rogers, "Calculating Engine Efficiency with the General Cycle Equation," May, 2020, available on-line at the following web address: https://www.researchgate.net/publicationl341133935_Calculating_Engine_Efficiency_with_t he_General_Cycle_Equation The above referenced paper by one of the applicants is reproduced substantially in its entirety herein.

CALCULATING ENGINE EFFICIENCY WITH THE GENERAL CYCLE EQUATION

Ernest Rogers May 4, 2020

As used here, a thermodynamic cycle is a sequence of changes in the conditions of a gas; the final step returns the gas to its initial condition. The General Cycle will be described in terms of reversible changes of an ideal gas. Most heat engines can be analyzed by use of such an "ideal" cycle. Only the essential steps are included—for example, in representing a four-stroke engine, the two strokes for exchanging the gas will be ignored.

The General Cycle has this name because it is capable of representing most commonly-used internal combustion engines, such as carbureted gasoline engines, Atkinson engines, diesels, and even gas turbine engines. By assuming that gas properties—the specific heats and specific heat ratio—are constants, a very simple formula can be obtained for heat engine efficiency. This simple formula is remarkably accurate in predicting the efficiency of real engines when 135 is used for the "constant" value of the specific heat ratio, and an energy loss factor is judiciously applied. (The analysis leading to the formula is for a reversible cycle with no heat or friction losses.)

One may ask, why is this formula for efficiency needed? The answer is that it is a teaching tool that shows us how to develop more efficient engines.

Describing the Cycle

The steps of the cycle are shown on the P—V Diagram (FIG. 1). The cycle has the following steps:

I. Starting at point 1, a gas is compressed adiabatically (without heat transfer) from $V_1$ to $V_2$. The compression ratio is $R_C=V_1/V_2$. The pressure increases from $P_1$ to $P_2$. The compression work from point 1 to point 2, $W_{12}$, is negative.

II. A first heat (fuel) input $Q_1$ raises pressure from $P_2$ to $P_3$ at constant volume. This $P_3$ is the maximum pressure. No work is done and $V_3=V_2$.

III. A second heat input $Q_2$ is added at constant pressure as the piston begins to move outward from $V_3$ to $V_4$. (Fuel began to burn at point 2 and burning is complete at point 4.) The total heat input is $Q_{IN}=Q_1+Q_2$. The work from point 3 to point 4 is $W_{34}$.

IV. The gas expands adiabatically from point 4 to point 5. The power stroke ends at point 5. The expansion ratio $R_E=V_5/V_2$ exceeds the compression ratio by the factor $A=V_5/V_1$. A is the Atkinson ratio. The work in this step, from point 4 to point 5, is $W_{45}$.

V. Heat is removed at constant volume. ($V_6=V_5$) Pressure decreases from $P_5$ to $P_1$, the initial pressure. ($P_6=P_1$)

VI. The gas is compressed and heat is removed at constant pressure. The volume decreases from $V_5$ to $V_1$ the initial volume, and the temperature returns to the initial temperature, $T_1$. ($V_6=V_5$) The work from point 6 to point 1, $W_{61}$, is negative.

The cycle is complete. The total heat removed in steps V and VI is the rejected heat, $Q_{oUT}$. The total work available from the cycle is $W=W_{12}+W_{34}+W_{45}\pm W_{61}$. In the ideal cycle, $W=Q_{IN}-Q_{OUT}$. In a real engine, the process is a little different than this ideal cycle—the steps will not be so neatly defined. The real engine is expected to have valves; for example: valves open at point 5 to remove exhaust gas. A fresh charge of air enters and the piston returns to point 1, the starting point. Then the valves are closed and a new cycle begins. Opening of valves in part of the cycle can cause a loss of work, as work against the atmosphere.

The efficiency of the cycle is obtained by comparing the total work W to the total heat input $Q_{IN}$. Efficiency is a dimensionless quantity. The efficiency of this ideal cycle can be expressed in terms of a set of defined dimensionless parameters for the cycle. The equation for cycle efficiency is:

$$\eta = 1 - \frac{\alpha\beta^{\gamma}A^{1-\gamma} + A\gamma - A - \gamma}{[\alpha(\beta-1)\gamma + \alpha - 1]R_C^{\gamma-1}}$$

Where $\eta$ is the ideal efficiency, $\alpha=P_3/P_2$ is the pressure ratio, $\beta=V_4V_3$ is the cutoff ratio ($V_3=V_2$).

$A=V_5/V_1$ is the Atkinson ratio, $R_C$ is the compression ratio, and $\gamma=C_P/C_V$ is the specific heat ratio.

As already mentioned, this equation encompasses most common engine cycles. If $\beta=1$, the equation simplifies to the equation for the Atkinson cycle. If this is further restricted to A=1, it becomes the Otto cycle. By setting A=1 only, you obtain the dual cycle. If you set $\alpha=1$ and A=1, you obtain the classical Diesel cycle. If you set $\alpha=1$ and $A=\beta$, it becomes the Brayton cycle. What is presented here does not cover any cycle that has a constant-temperature step, for example, the Carnot cycle.

In order to make good use of the equation, one must have some understanding of what limits should be placed on the selectable parameters, $\alpha$, $\beta$, A, and $R_C$. Then the equation can be the starting point of a search for a more efficient engine.

Our invention concerns the design and application of internal combustion engines having optimum efficiency, operating generally in accordance with a thermodynamic cycle called the General Cycle, and at prescribed products of Atkinson ratio and compression ratio ($AR_C$). An engine constructed in accordance with our invention having the required optimal conditions of $R_C$ and prescribed $AR_C$ comprises a multiplicity of volumes with enclosing structures, which volumes generally are of cylindrical form, each volume with an enclosed compressible fluid, or gas, that is cyclically compressed from a first volume to a second volume, heated by combustion, and expanded from the second volume to a third volume. These operations are performed by operation of mechanisms having parts such as pistons and valves, such that the ratio of the first volume to the second volume equals $R_C$, which is the compression ratio, and the ratio of the third volume to the first volume equals A, which is defined as the Atkinson ratio. As used to produce combined heat and power, our inventive engines produce electricity at near 60% efficiency while also providing an additional 30% or more of the input energy as high-quality heat.

DETAILED DESCRIPTION

In order to describe our invention, it will be necessary to review the scientific principles pertaining to it and to define terms. As currently practiced, our invention is a two-stroke direct-injected piston engine that is represented by the General Cycle, which is explained below.

General Cycle

Figure 1:
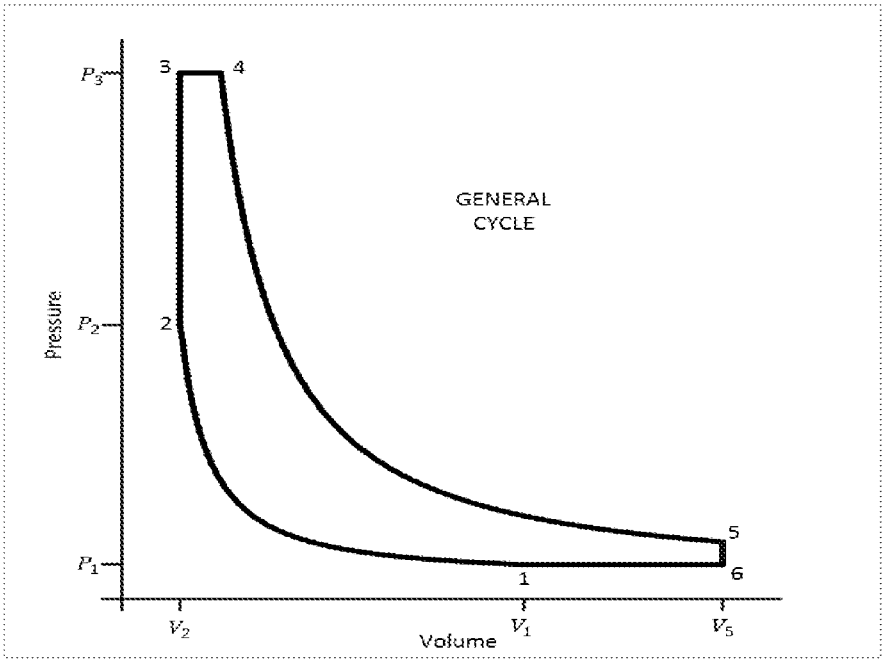
FIG. 1 shows the P-V diagram of our engine's thermodynamic cycle which is called the General Cycle.

The General Cycle is an idealized thermodynamic cycle that can represent most, if not all, common internal combustion engines. Usually it is analyzed as a sequence of reversible steps performed on a compressible working fluid. In a real engine, this compressible fluid is a gas comprising oxygen with any amount of other gases, such as air or a gas composed of air, fuel, or combustion products. The General Cycle is best understood by reference to the P-V diagram of FIG. 1. It has the following steps:

I. Starting at point 1, a fresh charge of compressible fluid is compressed from volume $V_1$ to volume $V_2$. The compression ratio is $R_C=V_1/V_2$. Pressure increases from $P_1$ to $P_2$. The compression work from point 1 to point 2, defined as $W_{12}$, is negative.

II. Beginning at point 2, a first heat input $Q_1$ from fuel raises the pressure from $P_2$ to $P_3$, at constant volume. This $P_3$ is the maximum pressure, and $V_3=V_2$.

III. Beginning at point 3, a second heat input $Q_2$ is added at constant pressure as the piston moves outward from $V_3$ to $V_4$. Fuel had begun to burn at point 2, and burning is complete at point 4. The total heat input is $Q_{IN}=Q_1+Q_2$. The expansion work from 3 to 4 is $W_{34}$.

IV. After the hot compressible fluid (combustion gas) expands from point 3 to point 4, it continues to expand to $V_5$ without further heat input. The power stroke is complete at point 5. In our engines, point 5 is at a substantially greater volume than point 1. The expansion ratio is defined as $R_E=V_5/V_2$ and exceeds the compression ratio by the factor $A=V_5/V_1$. A is called the Atkinson ratio. It is equivalent to $A=R_E/R_C$. The work from 4 to 5 is $W_{45}$.

V. Valves open at point 5 and remain open as the piston returns to 1, the starting point. A fresh charge of compressible fluid enters as the piston moves from $V_5$ to $V_1$, then the valves close and a new cycle begins. This recharge step is inherently irreversible and represents a departure from the fully reversible cycle model as explained in the referenced article by applicant Rogers. In the fully reversible case, this portion of the cycle is assigned two steps: first, a reduction of pressure at constant volume, and then a reduction of volume at constant pressure, to return to the starting point of the closed cycle. Opening the cycle as described here causes a loss of work against the atmosphere. The work against the atmosphere, $W_{ATM}$, is negative. The total work of this cycle is $W=W_{12}+W_{34}+W_{45}+W_{ATM}$. The efficiency of the cycle is obtained by dividing the total work W by total heat input $Q_{IN}$.

We caution that while the above explanation of the General Cycle is of great benefit for understanding our invention, it represents a particular example and only approximates processes that may occur in a real engine built according to the invention. One may, for example, program the rate of heat input $Q_2$ so as to restrain the maximum gas temperature (rather than maintaining constant pressure as described above) and thereby prevent formation of nitrogen oxides by nitrogen and oxygen molecules present in the combustion gas. Such a useful variation from the General Cycle should be understood to fall within the scope of our invention.

DESCRIPTION OF THE INVENTION

We have found that a two-stroke, direct-injected engine generally working in accordance with the General Cycle is superior to all other engines regarding the combined properties of efficiency, power density, and ease of construction. And we have for the first time found the optimum design conditions providing best efficiency for a two-stroke, direct-injected engine operating substantially in accordance with the General Cycle. Our invention concerns the application of these conditions to the construction of efficient engines. We will now describe the optimum conditions and show how they may be applied in novel, high-efficiency engine constructions.

We have found in our work that a practical upper limit of efficiency exists for internal combustion engines of our design. For our engines of most efficient and practical design, such as two-stroke, direct-injected engines, best efficiency lies in the general range of 60 to 65 percent brake efficiency, depending on the fuel used. In order to obtain such an optimum brake efficiency of approximately 60 percent or greater the following inequality must be satisfied:

$$(1)\ AR_C > 36.33 + 8788\ e^{-0375\ RC}$$

For these highly efficient engines, the most desirable values of compression ratio, $R_C$, are in the range from 19 to 30, as there is no practical benefit of a compression ratio greater than 30. The design property of Inequality 1 determines highly desired values for $AR_C$, which is the product of Atkinson ratio, A, and compression ratio, $R_C$, and which is also equal to the expansion ratio $R_E$. The following Table 1 illustrates minimum values of $AR_C$ satisfying the Inequality 1 for whole number compression ratios from 19 to 30.

Table 1. Minimum values of Atkinson Ratio and $AR_C$ for Internal Combustion Engines Having Compression Ratios, $R_C$, from 19 to 30 in Order to Obtain 60% or Greater Efficiency.

TABLE 1

Minimum values of Atkinson Ratio and $AR_C$ for Internal Combustion Engines Having Compression Ratios, $R_C$, from 19 to 30 in Order to Obtain 60% or Greater Efficiency.

| $R_C$ | A | $AR_C$ |
|---|---|---|
| 19 | 2.284 | 43.4 |
| 20 | 2.062 | 41.2 |
| 21 | 1.887 | 39.6 |
| 22 | 1.755 | 38.6 |
| 23 | 1.648 | 37.9 |
| 24 | 1.559 | 37.4 |
| 25 | 1.483 | 37.1 |
| 26 | 1.417 | 36.8 |
| 27 | 1.358 | 36.7 |
| 28 | 1.306 | 36.6 |
| 29 | 1.259 | 36.5 |
| 30 | 1.216 | 36.5 |

Figure 2:
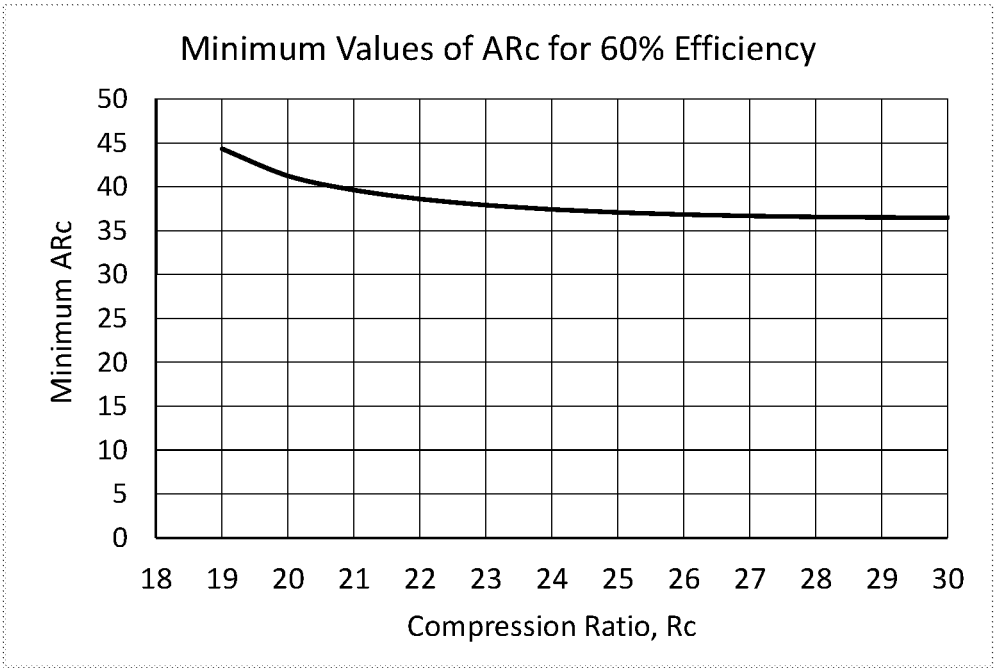
FIG. 2 is a graphical illustration of minimum values of $AR_C$ to obtain substantially 60% or higher brake efficiency for internal combustion engines of the present invention.

FIG. 2 illustrates the Inequality 1 and Table I in graphical form. One can see that the range of minimum values of $AR_C$ required to produce very efficient engines of near to 60% efficiency or more is a somewhat narrow band of values greater than 36, varying from about 36.5 to 43.4 for the particular design conditions of our work. Practical engines having $AR_C$ values according to the Inequality 1, which $AR_C$ values are generally greater than (or equal to) those shown in Table 1 and illustrated by the graph of FIG. 2, have not been known heretofore and may be regarded as falling within the scope of our invention.

Referring to FIG. 2, it can be seen that the efficiency level of 60% obtains substantially near a lower limit value of $AR_C$ approaching 36 for much of the range of compression ratios of practical importance. Therefore a simplification of the inequality formula of efficiency can be stated as:

$$(2)\ AR_C + R_E > 36.$$

A whole number simplification of the narrow band range of preferred expansion ratios is between 36 and 44, inclusive, as shown in FIG. 2.

Although deviations in construction of a practical engine which do not quite satisfy the original inequality may result in an engine with slightly less efficiency than 60%, it will be apparent to those skilled in the art that such an engine would still be highly efficient, and would exceed the efficiency of any practical engines known heretofore. Therefore, it should be considered that any such engine making use of the theoretical principles in its design and construction as herein set forth falls within the scope of our invention, regardless of the actual efficiency. Moreover, any engine which substantially approaches the design constraints herein set forth also falls within the scope of our invention.

We will now describe example constructions of engines designed in accordance with the principles that have been presented. In doing so we will describe per example only one cylinder and its accompanying structure, but it will be appreciated by one skilled in the art that engines are commonly composed of multiples of such similar cylinders and parts, and such constructions are within the scope of our present invention.

Figure 3:
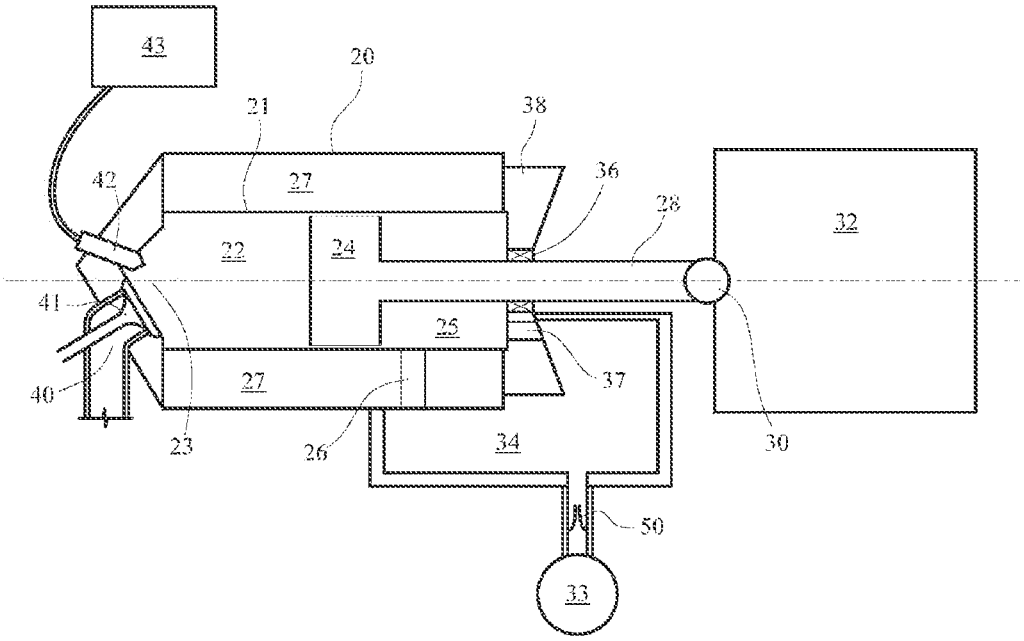
FIG. 3 shows a small engine having a piston with a shaft linkage connection between the piston and a transfer means for conveying power into and out of the engine, which power transfer means may be, for example, a crankshaft or other device.

A First Example Engine Construction Having Backstroke Compression and a Shaft Linkage and/or Articulated Connection We will now show a preferred engine construction that uses piston motions to input a fluid or gas such as air into the engine, and to compress and expand the fluid or gas as performed in the General Cycle. This particular example is presented in FIG. 3. FIG. 3 shows a small engine having a piston with a shaft linkage and/or an articulated connection linkage means-between the piston and a crankshaft or other power transfer means for conveying power into and out of the engine. Referring now to FIG. 3, FIG. 3 shows an engine 20 with a cylinder. The engine 20 has an engine body 27 with a cylinder bore 2L Within the cylinder bore 21 are a cylinder volume 22 with an included combustion chamber portion 23 located in the normally closed portion of the cylinder, a piston 24 having a front side and a back side, and a back volume 25 located in the back portion of the cylinder. The front side of piston 24 faces toward cylinder volume 22 containing the compressible fluid, and the back side of the piston is toward the back portion of the cylinder. A fluid inlet means for admitting fluid into the cylinder volume, which may be an intake port 26 is placed in the wall of engine body 27 in a position to input gas working fluid such as air during the recharge portion of the engine cycle. 28 to a power linkage means 30 for conveying power between the shaft and a power transfer means 32. An example of the power linkage means 30 is a connecting rod which is attached to a crankshaft, as is well known in the art. In this embodiment, the connecting rod does not have a direct connection to the piston, but connects to shaft 28. The shaft 28 is maintained in axial alignment with piston 24 and cylinder bore 21 by a shaft bearing and seal 36 and bearing housing 38 positioned at the back end of the cylinder. This shaft is provided because the stroke-to-bore ratio is too great to facilitate a direct articulated connection of a connecting rod to the piston as is common in the art. Power transfer means 32 for conveying power into and out of the engine is representative of any such apparatus as is common in the art, such as a flywheel on a crankshaft, or an electrical generator or the like, or a linear electromagnetic device.

During the recharge portion at the end of each cycle and before the beginning of the next cycle, piston 24 is in a position outward from intake port 26 so that the intake port his in communication with cylinder volume 22. A fluid supply means for supplying working fluid to cylinder volume 22 is provided. As an example, a compressible working fluid, otherwise known as a compressible gas such as air is introduced into cylinder volume 22 through a fluid inlet means for admitting the fluid into the cylinder volume through, for example, intake port 26. This fluid or gas is obtained from a fluid supply 33. The fluid supply 33 may be at atmospheric pressure, or may serve to pressurize the fluid, as is common for example with a turbocharger. The fluid flows from fluid supply 33 to a reservoir 34, then through intake port 26 into the cylinder volume 22. Reservoir 34 is external of the cylinder and other engine components such as a crankcase. An optional check valve, such as a reed valve 50, may be placed between the fluid supply 33 and reservoir 34. This check valve can optionally serve to prevent fluid from flowing back toward the gas fluid supply 33 as the piston moves outward, reducing the back volume 25. As the piston moves outward, fluid in the back volume 25 is forced out through intake port 26 and a back port 37. The back port 37, which provides for final discharge of fluid from the back volume 25, may be either situated in the end portion of the engine body 27 or adjacent to the shaft bearing 36 in bearing housing 38, as shown in FIG. 3. Outward motion of the piston 24 may serve to add pressure to the fluid. However, reservoir 34 is sized so that the increase in pressure is not so great as to substantially rob power from the piston. Shaft bearing 36 has a seal within it that prevents leakage of fluid from the back volume 25. The increase in pressure in reservoir 34 from the rearward motion of the piston facilitates the flow of the fluid through intake port 26 when the piston is in its most outward position.

Additional parts connected to the combustion chamber 23 are an exhaust port 40 with a valve 41, and an injection means for adding fuel to the compressed fluid, such as fuel injector 42. Port 40 with valve 41 form a closeable opening to selectably permit transfer of the fluid out of the cylinder. A heat input means for increasing the internal energy of the fluid in cylinder volume 22 is provided. In this embodiment the heat input means includes a fuel supply means for adding fuel to the fluid. As an example, this may be an injection means for transferring fuel into the cylinder volume, such as fuel injector 42 which receives fuel from a fuel supply system 43. This increases the internal energy of the fluid by combustion of the injected fuel. The heat input means may be controlled to add heat at a controlled rate, particularly both to raise the internal energy of the fluid to the desired peak pressure $P_3$, and to maintain that pressure for a controlled period of time.

The beginning of a cycle as defined here occurs at the time that the valve 41 is closed in the exhaust port 40 and the piston then begins to compress fluid in the cylinder volume 22. However, this does not occur at the time that the piston is near to the far outward position, called bottom dead center (BDC). Rather, the piston 24 moves inward from BDC with the exhaust valve 41 open until a position is reached where the cylinder volume 22 has been reduced by a factor of 1/A from the substantially greater value $V_5$ referred to above in describing the General Cycle and further described below. A is the Atkinson ratio. (In the present example, A has a value of 1.4 and the desired compression ratio is $R_C$=27.)

At the time that the valve 41 is fully closed, the value of cylinder volume 22 is $V_1$. All valves are closed and compression of the fluid, gas or air in the cylinder volume 22 begins as piston 24 continues to move inward toward top dead center (TDC) position, which is the point of least cylinder volume referred to as $V_2$ in the above General Cycle description. This least cylinder volume is substantially the volume of combustion chamber 23. As the piston 24 arrives at substantially the TDC position, heat $O_1$ is selectably added to the fluid in the cylinder volume 22 (presently equal to the volume of combustion chamber 23) by the injection and burning of fuel as described by General Cycle Step II. This process continues for a short time, initially controlably raising the fluid to a desired maximum pressure $P_3$ and associated temperature $T_3$ at a near-constant-volume condition. For a brief additional time as the piston moves outward, heat $O_2$ is controllably added as required and in a fashion to maintain substantially the constant pressure $P_3$, as described in Step III of the General Cycle. Then fuel cutoff occurs. At fuel cutoff, the cylinder volume 22 will have increased in volume to a value $V_4$ as described in the above General Cycle description. The heated gas, at a very substantial pressure, drives the piston farther thus sending power via the piston shaft 28, through power linkage means 30, and to the power transfer means 32. This continues until the piston reaches an outward position approaching BDC, at which point valve 41 opens to discharge burnt gases from the cylinder volume 22. At the effective time of valve 41 opening, the volume of cylinder volume 22 is substantially equal to $V_5$. Shortly after, the pressure in cylinder volume 22 falls below the pressure of the fluid in fluid reservoir 34. As the piston 24 continues to move outward, it uncovers intake port 26. Then a fresh charge of fluid displaces remaining burnt gases in the cylinder volume 22 and fills the cylinder volume 22 with a fresh charge of fluid. The initial pressure in cylinder volume 22, provided by the fresh charge of fluid, is the intake pressure, $P_1$. The replenishing of the cylinder volume 22 with fresh fluid continues for a length of time while the piston 24 completes its travel to BDC and where it then reverses direction, and covers the intake port 26 again by its inward motion. The valve 41 remains open for a further time as the piston continues to move inward. The valve 41 closes at the point where the cylinder volume 22 has returned to the value $V_1$. This is the point of beginning of a new cycle.

This two-stroke engine operating at an effective intake pressure $P_1$=115 kPa (1.15 bar) and having a compression ratio of $R_C$=27 has excellent fuel utilization for a broad range of renewable and fossil fuels. It gives good specific power (i.e., the power density in hp/liter) and substantially 60% brake efficiency or greater, depending on the fuel that is used. The engine has the following operating characteristics operating on No. 2 diesel fuel (ASTM D975-19a, 2-D (S-15) at 70% of stoichiometric mixture:

| | |
|---|---|
| Compression ratio, Rc | 27 |
| Atkinson ratio, A | 1.40 |
| $AR_C$ | 37.8 |
| Intake pressure, $P_1$ | 115 kPa |
| Peak cylinder pressure | 21 MPa |
| Fuel ignition temperature at TDC | 1310K |
| Brake efficiency | 60% |

As an example, this small engine has dimensions of:

| | |
|---|---|
| Bore, B | 83 mm, |
| Stroke, S | 195 mm, |
| Stroke-to-Bore, S/B | 2.35 |

At 1200 RPM, a mean piston speed of 8.0 meters per second.

| | |
|---|---|
| Specific power | 24.0 hp per liter |

Other fuels are also being evaluated:

Eli) gasoline (ASTM D4814-19, 10% ethanol)—efficiency is 60%

Fuel methanol (ASTM D5797, M100)—efficiency is above 64%

100311 The above small engine shown in FIG. 3 as well as other internal combustion engines operating according to an optimized General Cycle operation and built according to the condition of Inequality 1 operate at substantially 60% efficiency or better. Note that in this engine the ARc value of 1.4×27=37.8 is somewhat greater than the minimum $AR_C$ of Table 1: By using a higher value of $AR_C$, design conditions such as initial pressure and maximum cylinder pressure may be relaxed.

Fuel flexibility is an important benefit of our high-compression, high-efficiency engines. Except for changes in fuel injection means, the engine of FIG. 3 operates without modification on virtually any liquid or gaseous fuel. Some fuels such as methanol and methane are readily produced from renewable sources such as organic wastes. This is a significant benefit for prevention of global warming and climate change. We will now describe an especially preferred embodiment and set of design conditions for our engines that are well suited for construction of cogeneration units.

Figure 4:
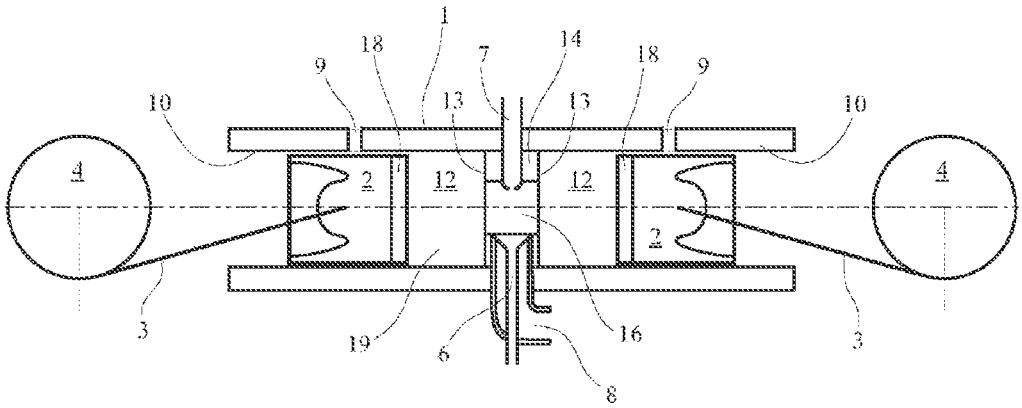
FIG. 4 presents an illustrative diagram for an opposed-piston engine that may be used for stationary cogeneration of electricity and heat or for transport applications.

A Second Example Preferred Engine Construction for Renewable Cogeneration of Electricity and Heat An especially preferred engine for cogeneration of heat and electric power, which operates generally in accordance with the General Cycle, and satisfies Inequality 1, is shown in FIG. 4. Referring now to FIG. 4, what is shown is a schematic diagram for a two-stroke, compression ignition, direct-injected opposed-piston engine. The engine has a substantially symmetrical construction regarding many of its parts; these duplicate parts are labeled with the same part number. Each mirrored half has practically the same construction and operation as in the previous engine example. The engine body 1 has two substantially axially-aligned cylindrical bores 10 containing pistons 2 that move in opposition to each other. The bores 10 and pistons 2 enclose two volumes 12. The two volumes 12 are separated from each other by a partition 14 positioned centrally between them. The partition 14 is composed mainly of metal or optionally of a ceramic material. As shown in FIG. 4, partition 14 has axially opposite surfaces 13 that form end faces of the two cylindrical volumes 12. However, the volumes 12 are always in communication with each other through a connecting combustion chamber 16 which passes through partition 14 and thus the two volumes 12 and combustion chamber 16 work cooperatively as a single normally closed cylinder volume in the engine body 1. The combustion chamber is of transverse dimensions substantially smaller than the bore width, and the pistons therefore cannot enter into the combustion chamber. The width of the partition 14 and therefore the axial length of the combustion chamber 16 are of a size that is substantially equal to the transverse dimension of the combustion chamber. The combustion chamber 16 is preferably cylindrical, but may be substantially spherical or cubic. This is so as to provide a combustion chamber with substantially the least surface area to contain the volume of the compressed fluid at the time of injection and/or ignition. The combustion chamber 16 is a single contiguous volume into which substantially all of the fluid is compressed when the pistons are at top dead center (TDC). The partition 14 is optionally composed primarily of a fracture-tough ceramic material such as a fine-grained zirconium dioxide material. Within the partition 14 are the combustion chamber 16 formed within the ceramic material, a fuel injector 7, and a closeable opening forming an exhaust port with valve 6. As shown in FIG. 4, the partition 14 is constructed with sufficient axial width so as to accommodate the exhaust port with valve 6 and injector 7. The combustion chamber 16 may be formed with a flat side into which valve 6 seats. The width between surfaces 13 is also sufficient to allow the combustion chamber 16 to be of a square form factor which means to have axial and transverse dimensions of near equal values, as shown in FIG. 4.

An optional ceramic face 18 is applied to each of the pistons 2. This ceramic material is applied by plasma or flame spraying or other method and in a sufficient thickness to substantially reduce heat transfer from the hot gases to the piston bodies. The combination of the ceramic combustion chamber 16 and the ceramic piston faces 18 is an important optional aspect of our invention as it greatly reduces energy loss by heat transfer.

At the time that the valve 6 is fully closed, the total operating volume is the value of cylinder volume $V_1$. In the first portion of the engine cycle, the pistons 2 move toward the partition 14, approaching its surfaces 13 very closely as the pistons reach their top dead center (TDC) positions. In so doing, they compress a compressible fluid or gas 19 into the combustion chamber 16. This fluid 19 may comprise oxygen, air, combustible gas or vapor, or any combination of suitable gases. The TDC position is the point of least cylinder volume referred to as $V_2$ in the above General Cycle description. This least cylinder volume is substantially the volume of combustion chamber 16. Heat is introduced into the combustion chamber 16 by a heat input means configured to increase internal energy in the fluid by injection of fuel through fuel injector 7, which fuel almost immediately commences burning in cooperation with the compressed fluid 19, thus forming a combusted gas at high temperature and pressure. Heat $O_1$ is selectably added to the fluid 19 in the cylinder volume (presently equal to the volume of combustion chamber 16) by the injection and burning of fuel as described by General Cycle Step II. This process continues for a short time, initially controlably raising the gas temperature and pressure to a desired maximum pressure $P_3$ and associated temperature $T_3$ at a near-constant-volume condition. (The volume of fluid 19 is nearly constant during the heat addition $O_1$ because this first heat addition occurs when the piston is near to TDC and it is moving very slowly.) For a brief additional time as the piston moves outward, heat $O_2$ is controllably added as required and in a fashion to maintain substantially the constant pressure $P_3$, as described in Step III of the General Cycle. Then fuel cutoff occurs. At fuel cutoff, the cylinder volume will have increased in volume to a value $V_4$ as described in the above General Cycle description. In the next portion of the cycle, the pistons 2 move outward, transferring energy to crankshafts 4 by means of connecting rods 3. This is the power stroke of the engine. The two rotatable crankshafts are mounted in relation to the engine body, and the connecting rods or linkages between each crankshaft and its associated piston drive the pistons or extract energy from the movement of the pistons. The crankshafts are timed to advance the pistons at substantially the same time. The power stroke ends as the pistons 2 draw near to uncovering a fluid inlet means for admitting fluid into the cylinder volume, in the form of intake ports 9 in the walls of the engine body. The exhaust port with valve 6 opens at the end of the power stroke, and combusted gas is discharged from the cylinder volume. This cylinder volume is composed of combined volumes 12 and combustion chamber 16. The combusted gas is discharged through an exhaust manifold system 8. Shortly afterward, the pistons 2 pass outward sufficiently to uncover intake ports 9. While the pistons 2 are outward past the intake ports 9, fluid 19 enters through the intake ports 9 and displaces remaining burnt gases within the volumes 12 and combustion chamber 16. As the pistons 2 reach BDC, they reverse their direction of motion and begin to move inward again.

A third portion of the cycle comprises the operation of the engine between the time of beginning of inward motion of the pistons 2 and the time at which the engine again begins to compress fluid for a new cycle. During this time interval, the pistons move a substantial distance inward. The end of the interval is defined by the effective closure of the valve 6. A key aspect of our invention concerns the positions of pistons 2 and the total operating volume of the engine at the times of opening and closing of the valve 6. The total operating volume is equal to the volume of the combustion chamber 16 plus the combined volumes of the two volumes 12. This total operating volume will now be referred to simply as "V" with a designating subscript that indicates the value of V at a particular point in the engine's cycle. With reference to the P-V diagram of FIG. 1, at the time that the valve 6 closes, the volume of V is $V_1$. When the pistons reach TDC, the value of V is $V_2$, which is substantially equal to $V_3$. At the end of heat addition, the value of V is $V_4$, and at the end of the power stroke, which is at the effective time of opening of the valve 6, the value of V is $V_5$. In accordance with our invention, the various values of V satisfy the following conditions:

$$V_5/V_1=A$$

And $AR_C>36.33+8788\ e^{-0375\ Rc}$ as has been discussed in detail above.

This second preferred engine construction is considered to be of great value for use in distributed power generation. The engine is imagined to be coupled to one or more electric generators of any desired type. In addition, the waste energy is to be collected at available locations. Approximately 60% of the energy in the engine fuel will be delivered as work to the electrical generator(s). Of that work, as much as 96% to 98% may be converted to electrical energy. The waste energy comprises approximately 40% of the energy in the engine's fuel. A portion of that energy may be collected in the form of high-quality heat. The efficiency of collection and transfer of this heat may be in the general range of 75% to 80%. The heat is referred to as being of high quality because it can be collected at a very substantial temperature, in the general range of 100 degrees Celsius to as much as 300 degrees to 400 degrees Celsius. High-quality heat has great practical value for heating, producing hot water or steam, and for industrial process heat. Combining the two system efficiencies, the engine's efficiency of producing electrical power with the efficiency of collection and use of heat, provides an overall system efficiency of approximately 90%. In this fashion, our invention can be of immense value in reducing dependence on fossil fuels, or fuels of any kind. Our engines may use any of several suitable fuels such as natural gas or biomethane, dimethyl ether, methanol, diesel fuel, gasoline, or a combination of fuels. Some of these fuels may be obtained from renewable as well as geologic sources. Basic physical properties and design parameters of the above example engine are:

| | |
|---|---|
| Cylinder Bore | 7.125 in (0.181 m) |
| Piston stroke (each side) | 9.250 in (0.235 m) |

-continued

| | |
|---|---|
| Cylinder length | 38.4 in (0.976 m) |
| Cylinder displacement | 10.0 liters |
| Wall intake port each side | 1.825 in (0.0463 m) |
| RPM for synchronous generation | 900 rpm |
| Compression ratio | 25 |
| Atkinson ratio | 1.52 |
| $AR_C$ | 38 |
| Intake pressure | 120 kPa (1.20 bar, 17.4 psia) |
| Intake temperature | 360 k (188 deg. F.) |
| Maximum pressure | 22.0 MPa (3200 psia) |

As mentioned, our cogeneration engine described above can provide both heat and electricity with a combined efficiency of 90% or greater, and causes no net increase in atmospheric greenhouse gas (e.g., $CO_2$) in its operation when using a renewable fuel. This engine combined with a synchronous generator has a fuel consumption of approximately 0.148 kg/kWh when operating on ultra-low-sulfur diesel fuel. Electrical generation is at approximately 57% efficiency. Thus, our new engine technology represents a great advance toward reduction of global warming and climate change.

What is claimed is:

1. An internal combustion engine operating generally in accordance with a thermodynamic cycle called the General Cycle, comprising:

a cylinder;

a compressible fluid within one portion of the cylinder;

a piston mounted to slide within the cylinder to alternatingly compress and expand the fluid;

a heat input means configured to increase internal energy of the fluid by combustion of an injected fuel, the heat input means increasing the heat of the compressible fluid in two heat inputs, a first heat input raising the pressure at substantially constant volume, and a second heat input added at substantially constant pressure;

at least one closeable opening within the cylinder to permit transfer of the fluid into or out of the cylinder;

a power transfer means in communication with the piston configured to move the piston or to extract energy from the movement of the piston;

the fluid alternatingly being compressed by a ratio of compression denoted as $R_C$, and being expanded by a ratio of expansion denoted as $R_E$, and the Atkinson ratio being denoted as A and defined as $A=R_E/R_C$; and the engine operationally satisfying the inequality: $AR_C \geq 36.33+8788e^{-0.375Rc}$.

2. The internal combustion engine of claim 1 having a compression ratio between 19 and 30.

3. An internal combustion engine operating generally in accordance with a thermodynamic cycle called the General Cycle, comprising:

a cylinder;

a compressible fluid within one portion of the cylinder;

a piston mounted to slide within the cylinder to alternatingly compress and expand the fluid;

a heat input means configured to increase internal energy of the fluid by combustion of an injected fuel, the injected fuel adding energy as a heat of combustion $Q_{IN}$ to the compressible fluid in two portions $Q_1$ and $Q_2$, a first heat input $Q_1$ generally added in accordance with the second step of the General Cycle, and a second heat input $Q_2$ generally added in accordance with the third step of the General Cycle;

at least one closeable opening within the cylinder to permit transfer of the fluid into or out of the cylinder;

a power transfer means in communication with the piston configured to move the piston or to extract energy from the movement of the piston;

the fluid alternatingly being compressed by a ratio of compression denoted as $R_C$, and being expanded by a ratio of expansion denoted as $R_E$;

the engine operationally satisfying the inequality: $R_E \geq 36$; and the engine having a compression ratio between 19 and 30.

4. The internal combustion engine of claim 3 wherein the expansion ratio is between 36 and 44.

5. A method of producing power at optimal efficiency from an internal combustion engine having a cylinder, a compressible working fluid within one portion of the cylinder, a piston mounted to slide within the cylinder to alternatingly compress and expand the fluid, and a power transfer means in communication with the piston configured to move the piston or to extract energy from the movement of the piston, the compressible working fluid being alternatingly compressed at a compression ratio denoted as $R_C$, and expanded at an expansion ratio denoted as $R_E$, the method comprising:

compressing a working fluid with a compression ratio, $R_C$, of between 19 and 30;

adding heat to the working fluid by internal combustion in two heat inputs, a first heat input raising the pressure at substantially constant volume, and a second heat input added at substantially constant pressure;

expanding the working fluid with an expansion ratio, $R_E$, of greater than 36; and extracting energy from the expansion of the working fluid, thereby producing power at high efficiency.

6. The method of producing power at optimal efficiency from the internal combustion engine of claim 5 wherein the expansion ratio, $R_E$, is between 36 and 44.

7. An internal combustion engine comprising:

a cylinder having a normally closed portion which contains a compressible fluid within the closed portion of the cylinder, and a back portion of the cylinder opposite the closed portion, and having a back end of the cylinder;

a closeable opening in the normally closed portion of the cylinder to selectably permit transfer of the fluid out of the cylinder;

a piston mounted to slide within the cylinder to alternatingly compress and expand the fluid, the piston having a front side facing the compressible fluid, and a back side opposite the front side;

a power transfer means in communication with the piston configured to move the piston or to extract energy from the movement of the piston;

a fuel supply means for adding fuel to the compressible fluid in the closed portion of the cylinder;

an intake port in the cylinder for allowing fluid to enter the cylinder in communication with the normally closed portion of the cylinder when the back side of the piston is substantially adjacent the back end of the cylinder;

a fluid supply means for providing compressible fluid to the intake port; and a fluid reservoir external of the cylinder and other engine components communicating between the fluid supply means and the intake port, with the operational rearward motion of the piston increasing the pressure in the reservoir.

8. The internal combustion engine of claim 7 wherein the closeable opening is timed in conjunction with the sliding of the piston to remain open for a portion of the time in the forward movement of the piston beyond the time at which the intake port is covered by the piston.

9. The internal combustion engine of claim 7 wherein the compressible fluid is compressed by a compression ratio of between 19 and 30, and the fluid is afterward expanded by an expansion ratio of greater than 36.

10. The internal combustion engine of claim 7 wherein the compressible fluid is compressed by a compression ratio of between 19 and 30, and the fluid is afterward expanded by an expansion ratio of between 36 and 44.

11. The internal combustion engine of claim 7 wherein the power transfer means communicates with the piston through a shaft attached axially to the back side of the piston and extending beyond the back end of the cylinder and a power linkage means for conveying power between the shaft and the power transfer means.

12. The internal combustion engine of claim 7 wherein fuel is injected to impart a first heat input at substantially constant volume and a second heat input at substantially constant pressure.

13. An internal combustion engine, comprising:

an engine body with two cylindrical bores that are substantially axially aligned;

two pistons slidably positioned within the bores to move in opposition to each other, and containing within the cylindrical bores and the pistons a compressible fluid;

a partition in the engine body between the cylindrical bores separating the compressible fluid into two volumes which are in open communication to work cooperatively, the partition forming therein a combustion chamber of transverse and axial dimensions substantially smaller than the bore width into which chamber the compressible fluid is substantially compressed when the pistons approach the partition;

a heat input means configured to increase internal energy in the fluid by injection of fuel into the compressible fluid, wherein the fuel is injected to impart a first heat input at substantially constant volume and a second heat input at substantially constant pressure;

an exhaust port with a valve therein within the engine body and the partition to selectably permit transfer of the compressible fluid out of the engine body; and a fluid inlet means for admitting compressible fluid into the combustion chamber and communicating volumes in the cylindrical bores.

* * * * *